United States Patent [19]

Ennis

[11] 3,953,936

[45] May 4, 1976

[54] YO-YO

[76] Inventor: Thomas H. Ennis, 4306 N. Shallowford Road, Chamblee, Ga. 30341

[22] Filed: Nov. 13, 1974

[21] Appl. No.: 523,450

[52] U.S. Cl. ..... 46/61
[51] Int. Cl.[2] ..... A63H 1/30
[58] Field of Search ..... 46/61

[56] References Cited

UNITED STATES PATENTS

| | | | |
|---|---|---|---|
| 2,629,202 | 2/1953 | Stivers et al. | 46/61 |
| 3,256,635 | 6/1966 | Radovan | 46/61 |
| 3,643,373 | 2/1972 | Russell | 46/61 |

*Primary Examiner*—Louis G. Mancene
*Assistant Examiner*—Robert F. Cutting
*Attorney, Agent, or Firm*—Newton, Hopkins & Ormsby

[57] ABSTRACT

A Yo-Yo in which opposed circular body segments are respectively, monolithic, being formed of a unitary molded plastic element of generally uniform thickness. The body segments are complimentary, and are joined by an axle. Radiating from the inner end portion of the hub, each body segment is a flat disc which merges with the inner edge of a cylindrical spacer ring. The outer edge portion of the spacer ring an arcuate convex flange which extends over the outer surface of the ring. The inner surfaces of the opposed body segments extend parallel to each other, but then diverge toward the outer periphery to provide additional space for movement of the string without causing precession of the Yo-Yo. In the second embodiment, central caps close the exposed outer surface area of the body segments.

15 Claims, 4 Drawing Figures

YO-YO

BACKGROUND OF THE INVENTION

1. Field of Invention:

This invention relates to a Yo-Yo and is more particularly concerned with a tight string Yo-Yo having improved performance characteristics.

2. Description of the Prior Art:

In the past, Yo-Yos have been extensively used throughout the world. Initially, such Yo-Yos were made of wool or metal; however, more recently the Yo-Yos have been made of plastic. A conventional plastic Yo-Yo has two shell elements for each body segment, the two body segments being joined by a central axle. The shell elements are joined together to define a hollow interior.

It has generally been determined that it is preferable for a Yo-Yo to weigh between about 55 grams to 60 grams. This enables the string which encompasses the axle to hold the Yo-Yo in a spinning condition without causing it to wind up on the string, until the string is momentarily slackened.

The four plastic shells of the conventional Yo-Yo are injection molded, and are of non-uniform dimensions. Therefore, the cooling time for each segment, in the mold, must be determined by the thickest portion.

The body segments of the present invention, being monolithic and of uniformly thin cross-section are injection molded in a reduced time and yet has a pleasing appearance.

In the conventional Yo-Yo, the axle holds the opposed complimentary body segments apart so that the flat inner surfaces of the body segments are parallel and spaced from each other, except immediately adjacent the periphery, where the body segments are curved, outwardly. When the prior art Yo-Yo is thrown incorrectly, the string will tend to bind along the periphery of one of the body segments and thereby cause precession of the Yo-Yo. The present invention provides for a tapered inner surface, adjacent the periphery so as to increase the curve angle relationship and thereby reduce the likelihood of the string binding on the inner surface, even though the Yo-Yo is manipulated by a novice.

BRIEF DESCRIPTION OF THE INVENTION

Briefly described, the present invention includes a Yo-Yo having a pair of complimentary opposed monolithic or unitary body segments joined by a central axle. Each body segment has a cylindrical hub, closed at its outer end portion and open at its inner end portion, for receiving in its bore the end portion of the axle. Each body segment includes an inner circular plate or disc which radiates outwardly in a radial plane from the inner edge portion of the hub. Each such disc is provided, at its outer periphery, with an axially extending cylindrical, outwardly projecting, spacer ring concentrically surrounding the hub and connected by its inner edge portion to the periphery of the plate.

A convexed annular peripheral shield or flange projects generally, in a radial direction from the outer edge portion of the spacer ring, curving progressively inwardly. The two arcuate flanges of the assembled body segments terminate with their peripheries in spaced opposed relationship to each other Between the spacer ring and the outer periphery of the annular flange there is provided an outer weighting ring, concentric with and surrounding both the hub and the spacer ring. The weighting ring projects inwardly from the annular flange. Between the hub and the spacer ring is an additional weighting ring. The hub, the inner weighing ring, the spacer ring and the outer weighting ring are all concentric with each other.

When the segments are assembled, the inner opposed edges of the annular flanges are spaced apart by a distance greater than the space between the opposed edges of the outer rings and these are spaced apart by a distance greater than the space between the opposed inner plates. In this way, a progressively wider space toward the periphery is provided for the string.

In this second embodiment, essentially the same body segment elements are provided, except that the intermediate spacer ring is longer axially than the hub and the inner weighting ring so that the inner weighting ring and the spacer ring frictionally receive the cylindrical wall of a closure cap.

Accordingly, it is the object of the present invention to provide a Yo-Yo which is inexpensive to manufacture, durable in structure and efficient in operation.

Another object of the present invention is to provide a Yo-Yo which has improved performance characteristics, being particularly suitable for "tight string tricks".

Another object of the present invention is to provide a Yo-Yo which has few parts, the parts being readily and easily injection molded.

Another object of the present invention is to provide a Yo-Yo which has a pleasing appearance and yet can be molded readily and easily, Another object of the present invention is to provide a Yo-Yo which can be utilized by a novice and which has provisions for reducing the likelihood of precession caused when the string strikes the edge portion of the body segment of the Yo-Yo.

Other objects, features and advantages of the present invention will become apparent from the following description when taken in conjection with the accompanying drawing wherein like characters of reference designate corresponding parts throughout the several views.

DETAILED DESCRIPTION OF THE DRAWINGS

Figure 1:
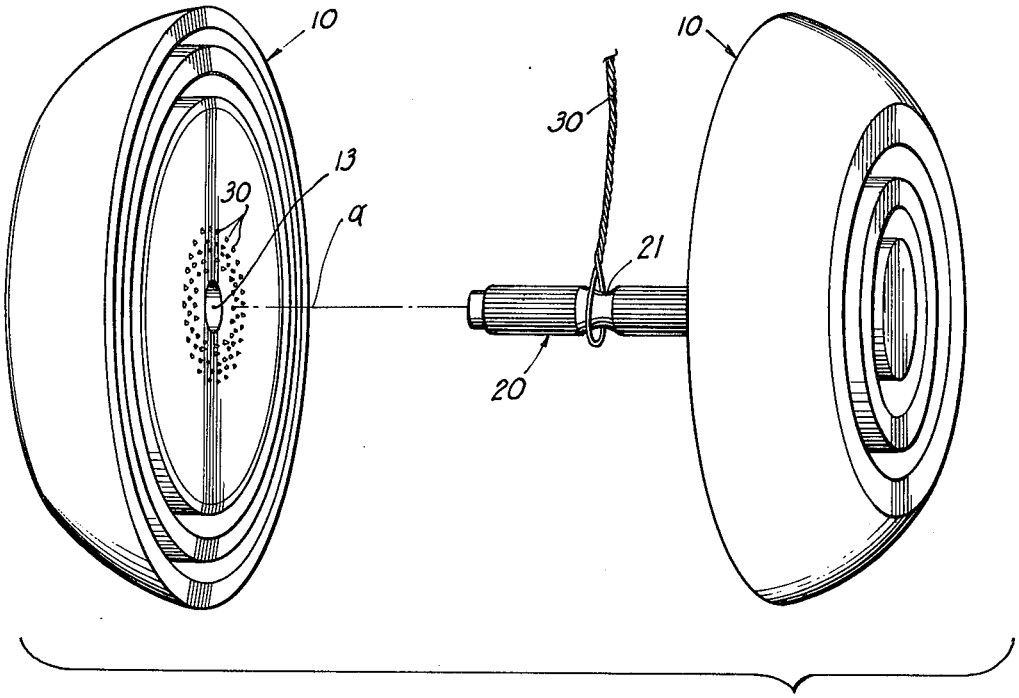
FIG. 1 is an exploded perspective view of one embodiment of a Yo-Yo constructed in accordance with the present invention.
Figure 2:
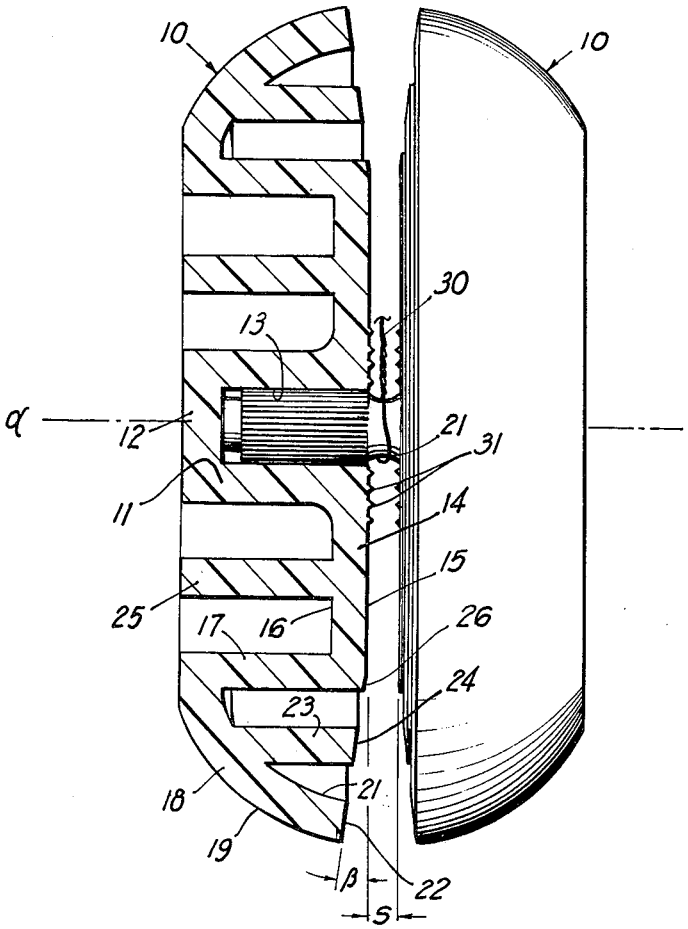
FIG. 2 is an end elevational view partially broken away of one side of the Yo-Yo depicted in FIG. 1.

In FIGS. 1 and 2 the first embodiment of the present invention is depicted. This Yo-Yo includes a pair of opposed body segments 10 which are complimentary and identical to each other. The two body segments 10 are joined together by a central axle, spindle or shaft, denoted generally by numeral 20.

In more detail, each body segment 10 is formed as a monolithic or unitary plastic body by injection molding. The body segment 10 includes a central cylindrical hub 11 closed at its outer end by a radially extending closure plate 12. Thus, the cylindrical hub 11 and the plate 12 form a cup having a central bore 13 of uniform inside diameter which receives one end portion of the round shaft 20. The opposed complimentary hubs 11 of the assembled body segments 10 receive the end portions of the axle 20 so as to space inner ends of the two hubs 11 apart by a space S or distance of approximately .080 to approximately .090 inch. The central portion of the axle 20 is provided with a concaved, uniformly curved, peripheral groove, indicated by numeral 21. The width of the groove 21 occupies substantially the entire space between the abutting body segments 10.

Each body segment 10 includes a flat circular plate or disc 14 which radiates or projects outwardly from the inner edge portion of the hub 11. This plate 14 is a flat member of uniform thickness, provided with a flat inner surface 15 and a flat outer surface 16.

At the outer periphery of each plate 14 an intermediate cylindrical spacer ring 17 is provided. This spacer ring 17 projects in cantilever fashion, outwardly over hub 11 to terminate in approximately the same radical place with the outer surface of the plate 12. Spacer ring 17 is concentric with and the same axial length as the hub 11, the ring 17 being supported solely by its inner end which is integrally joined to the periphery of plate 14.

Extending from the outer edge of the ring 17 is an arcuate annular shield or flange 18 provided with a concaved inner surface 21 and a convex outer surface 19. The shield or flange 18 generally conceals the outer surface of the spacer ring 17. The annular flange 18 of the respective body segments 10 terminate in space opposed ends 22. Projecting inwardly from the inner surface 21 of each annular flange 18 is a cylindrical outer weighting ring 23. The inner end 24 of the opposed rings 23 are spaced from each other. Between the hub 11 and the spacer ring 17 is a second or inner cylindrical weighting ring 25, this weighting ring 25 projecting from the outer surface 16 of the plate 14.

As seen in FIG. 2, the inner surface 15 of plates 14 are parallel to each other being spaced apart by axle 20 by a distance or space S of from about 0.080 to about 0.090 inch.

At the outer peripherial extremity of plate 14, the disc or plate is beveled to provide a narrow annular conical surface 26 surrounding surface 15.

In cross-section, as seen in FIG. 2, the surface 26 is straight, being in a common straight line with ends 22 and 24. Thus, the bevel 26, the end 24 and the end 22 are within a common conical surface generated by the movement of a straight line in a circular path about axis $\alpha$, the line being disposed at an angle $\beta$ to the plane of surface 15 of between 6° and about 10°, preferably 8°.

As is usual, a string 30 loosely encompasses the groove 21 or axle 20. This string 30 projects outwardly between the space S defined by the opposed body segments 10.

Along the inner surface of inner plate 14 there are provided a plurality of cone shaped protuberances 31 which are disposed in a circle and project inwardly toward the string 30. These cone shaped protuberances 31 are rounded at their outer end portions and function to engage the string 30 so as to snare it momentarily when the string 30 is momentarily in as slack condition. This, of course, is readily understood by users of the Yo-Yo.

Figure 3:
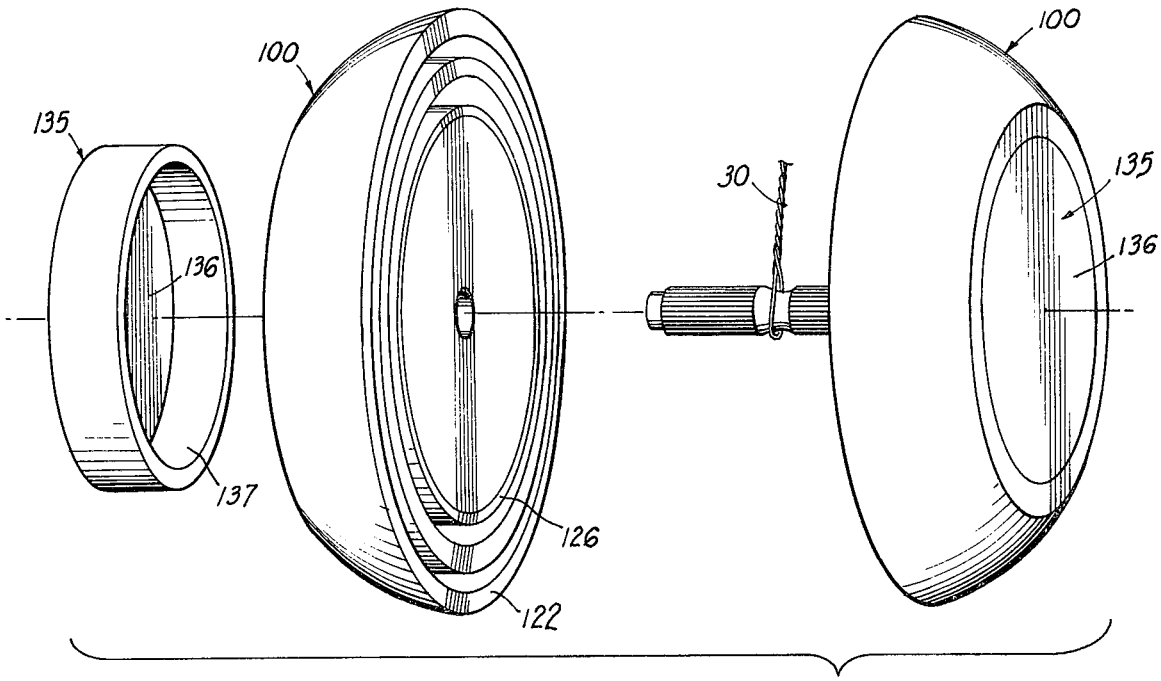
FIG. 3 is an exploded perspective view of a second embodiment of a Yo-Yo constructed in accordance with the present invention.
Figure 4:
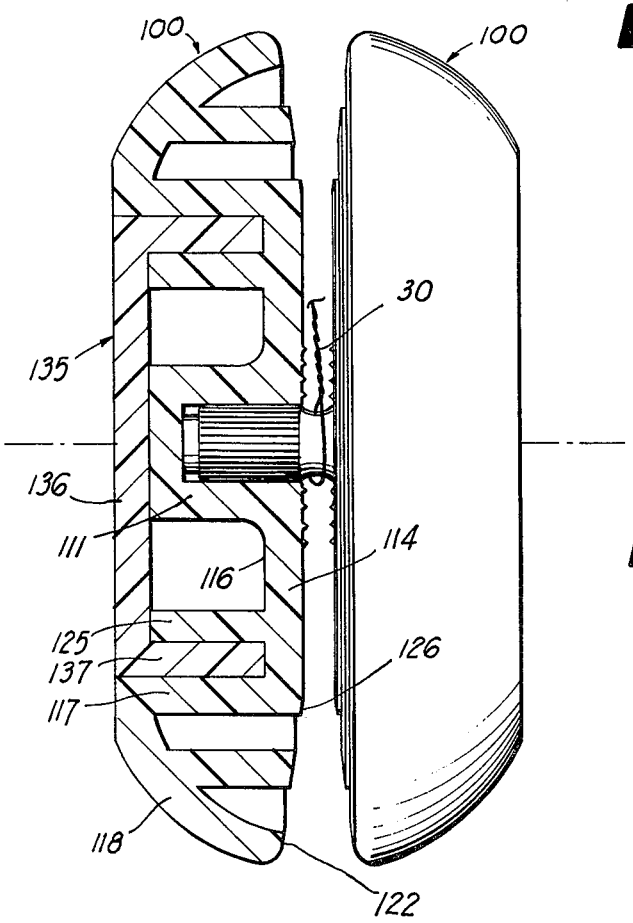
FIG. 4 is an end elevational view partially broken away of the Yo-Yo depicted in FIG. 3.

In the second embodiment depicted in FIGS. 3 and 4 the body segments 100 are identical to the bdy segments 10 except that the body 111 and inner weighting ring 125 terminate in a common plane spaced inwardly from the outer ring 117. This is to accomodate a cap, denoted generally by numeral 135. This cap 135 has a flat circular bottom plate 136 and a cylindrical side wall 137 which projects up from the inner surface of plate 136. The height or length of the wall 137 is approximately the axial length of the inner ring and the hub, being measured from the outer surface 116 of the plate 114. The outside diameter of the wall 137 is approximately equal to the inside diameter of the spacer ring 117, the inside diameter of wall 137 is approximately equal to the outside diameter of inner ring 125 so that the cap can be snugly sandwiched between the inner periphery of the spacer ring 117 and the outer periphery of ring 125. The thickness of the end plate 126 is approximately equal to the difference between the axial length of hub 111 and the axial length of the spacer ring 117 so that the outer surface 138 of the plate 136 terminates in a common plane with the surface of the outer end of spacer ring 117.

The inner peripheral portion or end 122 of the outer annular shield or flange 118, in cross-section is rounded or convexed, rather than being straight as is end 22. This tends to reduce the wear on the string, such as string 30.

It will be observed that the segments 10 and 100 have elements which are of uniform thickness. For example, the thickness of the hub 11 or 111 are from about 1/16 inch to about ⅛ inch. The body thickness, throughout segment 10 is preferably about 3/32 inch. Its width is about ⅝ inch and its diameter about 2¼ inch. The axle 20 is about ¼ inch. There is about a 3/16 inch clearance or space between hub 11 and inner ring 25, and about 3/16 inch clearance or space between ring 25 and ring 17. The clearance or space between ring 25 and outer ring 25 is about 3/32 inch, as is the clearance or space between the endof ring 25 and end 22.

In the embodiments here depicted, the weight distribution can be quite easily regulated so as to place the preponderance of the weight toward the periphery or toward the central portion of the Yo-Yo.

The present Yo-Yo, as depicted in the drawings, tends to concentrate the weight in the central portion molding time the Yo-Yo. This gives the Yo-Yo a low rotational inertia which enables the Yo-Yo to come up to speed quickly when it is thrown. "Tight string" tricks, such as "Over the Falls" and "Three Leaf Clover" are facilitated by such Yo-Yos.

Since the segments 10 and 100 are unitary or monolithic, as opposed to a conventional Yo-Yo, injection moldingtime is reduced quite considerably to produce a finished Yo-Yo and assembly time is also reduced. Even utilizing the embodiment depicted in FIGS. 3 and 4, less molding time and less assembly time is probably necessary to produce the second embodiment than to produce a conventional Yo-Yo. Furthermore, the press fitting of the parts of the second embodiment together eliminate the expense of gluing.

The second embodiment also lends itself well to ultrasonic welding, in the event that the cap is to be secured permanently in place.

What is claimed is:

1. A Yo-Yo comprising a pair of opposed circular body segments and an axle transversing a central spacial portion of the Yo-Yo between the body segments joining said body segments together, each body segment including a central hub receiving an end portion of the axle, a ring surrounding said central hub and disposed in concentric relationship thereto, an inner plate joining said hub and said ring and an outer flange projecting outwardly from the outer edge of said ring, said flange curving inwardly towards said central spacial portion over the outer surface of said ring.

2. The Yo-Yo defined in claim 1 including a weighting ring disposed concentrically in spaced relationship between said hub and said first mentioned ring.

3. The Yo-Yo defined in claim 2 wherein said body segment includes a second weighting ring disposed outwardly of said first mentioned ring said second weighting ring being integrally joined to the inner surface of said flange and being spaced from the outer periphery of said first mentioned ring.

4. The Yo-Yo defined in claim 1 including a cap extending over said hub, said cap having a wall frictionally carried by the periphery of said ring.

5. The structure defined in claim 4 wherein said cap is cup shaped.

6. The structure defined in claim 5 including a second ring between said hub and said first mentioned ring, said first mentioned ring and said second ring frictionally receiving said wall therebetween.

7. The Yo-Yo defined in claim 1 wherein each of said body segments include a plurality of inwardly protruding protuberances disposed around said axle, said protuberances protruding from the inner surface of said plate.

8. The Yo-Yo defined in claim 1 including a pair of weighting rings disposed on opposite sides of said first mentioned ring, the inner weighting ring extending from the outer surface of said plate and the outer weighting ring extending from the inner surface of said flange.

9. A Yo-Yo comprising an axle and a pair of opposed complimentary body segments on the ends of said axle about a central spacial portion of the Yo-Yo, each of said segments being monolithic and composed of plastic, each of said segments including a central hub provided with a bore receiving an end portion of said axle, a spacer ring surrounding said hub in concentric relationship, a plate connecting the adjacent ends of said hub and said ring and an annular flange extending from the other end of said ring radially outwardly of and over the outer periphery of said ring towards said central spacial portion of the Yo-Yo.

10. The Yo-Yo as defined in claim 9 wherein said adjacent ends of said hub and said ring are the inner ends thereof, said plate of each segment having a flat inner surface spaced from and parallel to the inner surface of the plate of the other segment, the inner ends of the flanges of said segments terminating in opposed spaced relationship to each other, the space between said ends being greater than the space between the inner surfaces of the plates of said segments.

11. The Yo-Yo defined in claim 10 wherein each segment includes a cylindrical weighting ring projecting from the inner surface of said flange, said weighting ring being concentric with and spaced outwardly from said spacer ring.

12. The Yo-Yo defined in claim 11 wherein the inner ends of the weighting rings of said segments terminate in spaced opposed relationship, the space between said inner ends of said weighting rings being greater than the space between said plates and less than the space between said ends of said flanges.

13. The Yo-Yo defined in claim 11 wherein each segment includes an inner weighting ring between said hub and said spacer ring, said inner weighting ring being carried by its end by said plate.

14. The Yo-Yo defined in claim 13 wherein each segment includes a cap covering said hub and said inner spacer ring.

15. The Yo-Yo defined in claim 14 wherein said cap has a cylindrical wall frictionally received between said spacer ring and said inner weighting ring.

* * * * *